United States Patent [19]

Boots

[11] 4,383,028

[45] May 10, 1983

[54] PHOTOGRAPHIC CHEMISTRY

[75] Inventor: Byron R. Boots, Hayward, Calif.

[73] Assignee: Lorin W. Boots, Red Bluff, Calif.

[21] Appl. No.: 289,561

[22] Filed: Aug. 3, 1981

[51] Int. Cl.[3] ..... G03C 5/30

[52] U.S. Cl. ..... 430/483; 430/484; 430/485; 430/486; 430/490; 430/493

[58] Field of Search ..... 430/486, 493, 483–485, 430/490; 252/542, 171

[56] References Cited

U.S. PATENT DOCUMENTS

| | | | |
|---|---|---|---|
| 3,438,776 | 4/1969 | Yudelson | 430/493 |
| 3,489,686 | 1/1970 | Parran | 252/542 |
| 3,594,322 | 7/1971 | Wilson | 252/542 |
| 3,859,225 | 1/1975 | McKnight | 252/171 |
| 4,267,255 | 5/1981 | Schreiber | 430/486 |

OTHER PUBLICATIONS

Research Disclosure, Apr. 1974, 12021, pp. 14–16.

Abst. of Belgium patent 612439, Jan. 9, 1962.

*Primary Examiner*—Mary F. Downey

*Attorney, Agent, or Firm*—John L. McGannon

[57] ABSTRACT

A photographic chemistry comprised of a solution containing a mixture of different chemicals which cooperate to minimize the need for long film exposure times to achieve high film quality and contrast. The photographic chemistry includes a number of alkalies in a pH range from about 8 to 14, a developer in solution with the alkalies, a solvent mixed with the alkalies and the developer, a modified alkanolamide in solution with the alkalies, the developer and the solvent, and a hydrotrope mixed with the modified alkanolamide. Other chemicals that can be used in the photographic chemistry include an emulsion penetrant, a cleaner for various components of film processing equipment, a chelating agent, and an enzyme to enhance the reactions of the various chemicals in the photographic chemistry. A specific mixture of chemicals is disclosed.

33 Claims, No Drawings

PHOTOGRAPHIC CHEMISTRY

This invention relates to improvements in photographic developers and, more particularly, to an improved photographic chemistry which allows increased effective emulsion speeds and a relatively long gray range in films developed by the use of the photographic chemistry.

BACKGROUND OF THE INVENTION

Conventional photographic chemistries have limitations which are well known. Such limitations require that a photographic film be exposed for a sufficiently long time so that conventional photographic chemistries can develop the film to provide the desired contrast and other results to permit the proper analysis of the developed film to obtain the desired information therefrom. In the case of X-rays, long exposure times are harmful to human beings and precautions should be taken to assure that a patient does not receive an unnecessary overexposure of X-rays. However, a safer exposure to X-rays is, in many cases, not sufficient to assure that the X-ray film, when developed by using conventional photographic chemistries, has the proper information recorded on it. Either the information cannot be obtained from the film or higher exposure of the patient to the X-rays is required.

Another drawback concerning the use of conventional photographic chemistries is that they do not contain ingredients which properly clean certain components, such as rollers, automatic film processing equipment sufficiently to prevent frequent maintenance of such equipment. As a result, photographic developing processes must be interrupted for such maintenance to clean the equipment so that the equipment can be placed in operation once again as soon as possible.

SUMMARY OF THE INVENTION

The present invention is directed to a photographic chemistry which operates to develop exposed silver halides in a photographic emulsion, which halides were previously not capable of being developed with conventional photographic chemistries because of underexposure of the halides (to a light or other radiation source). Thus, the present invention is a distinct advance over conventional photographic chemistries because it allows increased effective emulsion speeds and a longer gray range than is obtainable with conventional chemistries. As a result, high quality photographic images may be obtained even with minimum exposure times. This is an especially advantageous feature when the photographic chemistry of this invention is used to develop a photographic emulsion used in non-invasive diagnostic imaging (such as X-rays), because the dosage can be reduced over that conventionally used to thereby minimize the harmful effects on a patient being subjected to X-rays.

Other advantages of the photochemistry of the present invention is it provides a developer which is functional at a lower temperature than that at which conventional developers operate (especially in rapid-processors used in the medical profession), resulting in a longer operating life of the chemistry itself. By keeping the developer at a lower operating temperature than conventional chemistries, the developer will last longer because of less oxidation. An additional benefit is a reduction of energy costs from heating the developer itself, keeping the processor temperature lower all the way through, and shorter exposures by the X-ray generator, as well as less potential damage to film emulsions which may normally be caused by excessive heat and swelling. Conventional photochemistries for rapid processing must include a hardener in the developer (such as glutaraldehyde) to prevent these problems. This invention makes that unnecessary.

The photochemistry of the present invention further provides an improved developer which operates to clean process machine parts and tends to preserve the integrity of rollers of process machines. Using conventional photochemistries the rollers soak up solution and film/developer residues, and mineral or organic contaminants can form in the tank, on the rollers and film guides, thus necessitating the replacement of rollers and thorough cleaning more often than with the chemistry of the present invention. The higher conventional operating temperatures also contribute to the processor problems. By keeping the temperature lower and keeping the processor cleaner as with the present invention, roller life is prolonged to a considerable degree and some machine breakdowns may be avoided. The present invention is further advantageous because it lacks the toxicity normally associated with conventional chemistries which use glutaraldehyde and unreacted aldehydes as hardeners in the developer, which the present invention does not need.

The present invention includes a developer comprised of a mixture of different chemicals, some of which may appear to perform the same function in the photographic chemistry itself. The present invention has a number of alkalies ranging from slightly alkaline to highly alkaline, and it is important that they be balanced in a stair-step progression. Such alkalies are so balanced in the photochemistries of the present invention. As examples of the various alkalies in the photographic chemistry of the present invention and their relative pH's, the following alkalies could be used:

| | |
|---|---|
| sodium sulfite | pH 8–9 |
| modified alkanolamides | pH 9–10 |
| potassium carbonate | pH 10–11.5 |
| potassium silicate | pH 10.5–11.7 |
| potassium hydroxide | pH up to 14 |

With the alkalies in the stair-step fashion as set forth above, fast high-accutance formulas for panchromatic films can be obtained. As an example, with the present developer, it is possible to process Kodak Panatomic-X (ASA 32) at E.I.s (exposure indexes) over 400 ASA with better results than with conventional photochemistries (at normal exposure levels). In the balancing of alkalies, a rule of thumb is that at least a minimum of 1% solution of each alkali in the stair-step is desired except the modified alkanolamide which may be as low as 0.00001%.

In Table 1, there is a representative photographic chemistry of the present invention. It is comprised initially of three solutions. The first solution, Solution I, is prepared, followed by the preparation of the second solution, Solution II. Then Solutions I and II are mixed together. The remaining chemicals are added to the mixture of Solutions I and II in the order listed. The result is a representative example of the photographic chemistry of the present invention.

Private tests conducted in the clinic of Dr. B. Peck Lau, M.D. Radiation Oncology and Nuclear Medicine Medical Clinic, Inc., Fresno, Calif., have shown that the present invention permits a 50% reduction in radiation to patients for diagnostic X-rays compared directly to state-of-the-art rapid processor X-ray chemistry (Kodak brand used for comparison). Higher reductions are possible with the present invention in conjunction with technique modification (kVp-mAs level variations by the radiologist), amounting to over 80% reduction in field tests, depending on film/screen/chemistry/technique combinations in use (varies greatly from clinic to clinic).

Among the chemicals in the photographic chemistry of the present invention is diacetone alcohol (4-Hydroxy-4-methyl-2-pentanone). This chemical is used as a solvent and a cleaner. It is further used as an intermediate between other chemicals so as to make other chemicals compatible with each other. Furthermore, diacetone alcohol serves as a penetrant so that the quicker penetration of the emulsion by the chemicals, the quicker the charge-barrier effect (emulsion minus charge vs. chemical minus charge) is penetrated.

Dimethyl formamide (DMF; N,N-dimethylformamide) is included in the photochemistry of the present invention because it serves as a "universal" solvent, inasmuch as it is a dipolar aprotic solvent that is miscible with water and most organic solvents. It is a penetrant and an emulsion hardener and protector, and it is used also as a chemical compatibility regulator.

Acetone (Dimethylketone; 2-propanone) is also included in the photochemistry of the present invention. It serves as a cleaner of processing machines, a new use in combination with the other chemicals of the photographic chemistry of the present invention. Acetone further acts as an organic developing agent solvent and emulsion penetrant, thus carrying developing agents rapidly into the emulsion with little or no regard for the charge-barrier effect.

The modified alkanolamide in the developer of the present invention is unique in combination with the other chemicals of the developer. Such a modified alkanolamide can be cocamide diethanolamine (Coco DEA). It serves as a pH builder and stabilizer, a wetting agent and detergent which is biodegradable, but necessitating the use of an hydrotrope in high builder level formulae, i.e., phosphates used to raise the pH levels of a solution. For instance, a useable modified alkanolamide is Clindrol 202 CGN, manufactured and sold by the Clintwood Chemical Company, Chicago, Ill.

Sodium xylenesulfonate (dimethylbenzenesulfonic acid, sodium salt) is a typical hydrotrope for use with the modified alkanolamide. A suitable hydrotrope is SXS-40, manufactured and sold by Pilot Industries of Los Angeles, Calif. The hydrotrope level depends upon the amount of modified alkanolamide used, the amount and types of pH builders and other solvents in solution, and whether the formula is a pre-mix or concentrate for use in the marketplace.

These criteria establish that the range of hydrotrope may be from 0.01% of the total solution to 50% or more, depending on the type of application (concentrate or pre-mix). The hydrotrope defined by sodium xylenesulfonate operates as a compatibility agent so that other chemicals are compatible with water (in the presence of other generally non-compatible chemicals). It also acts as a surfactant and as a cleaning agent. As a surfactant, it increases the penetrating ability of the solution and controls foam levels so that the flow of the developer is increased while turbulence in the developer is decreased (in rapid processors).

The modified alkanolamide, in addition to its foregoing properties, further acts as a solvent, as a surfactant, as a cleaner, and as a buffer. As a buffer, it neutralizes acids introduced into solution (from development by-products, step-reactions) so as to cause the solution not to abruptly change activity or pH upon such intrusion (of acid or alkali). The balancing of the alkalis and other ingredients of the present invention provides a developer which is, in effect, a balanced alkali buffer system.

Potassium silicate in the solution is used as a cleaner and as an alkali or pH builder. It also preserves the integrity of the emulsion subjected to the developer of the present invention and tends to give low fog, high contrast images. A number of chemicals of the present invention are incompatible with potassium silicate and should be put into solution as indicated in Table I. A suitable potassium silicate is one denoted as Kasil No. 1 made by Philadelphia Quartz Company, Philadelphia, Pa.

Another chemical that can be used in the developer of the present invention, although not used in a solution as shown in Table 1, is dimethyl sulfoxide (DMSO; methyl sulfoxide). It is a solvent and a penetrant as well as a lubricant. It conditions rollers in rapid processors and preserves the film emulsion. It also reduces the opacity of the emulsion base fog.

Methanol is used in the present invention as a solvent, a cleaner, a buffering agent and an intermediate compatibility agent. It also aids in preventing excessive emulsion swelling and softening while allowing the penetration of developing agents, for which it is also a solvent.

Ethylenediamine tetraacetic acid, tetrasodium salt (EDTA $Na_4$), in the form of Versene 100, a commercially available solution of EDTA $Na_4$ (40%), is used as a chelating (sequestering) agent, which is not an uncommon use, except in conjunction with uncommon photochemical ingredients.

Potassium carbonate is a pH builder or accelerator which is used as well for its higher photochemical activity and solution concentration ability (over the Na form), in its particular pH range. Potassium hydroxide, a pH builder, is used in the present invention to alter the mole ratio of the potassium silicate. This mole ratio (Kasil #1) is 2.50:1 $SiO_2$:$K_2O$ and is adjusted by the addition of potassium hydroxide to approximately 1:1.

Enzymes are used as organic catalysts as follows: they can be either amylolytic or proteolytic enzymes, a combination of amylolytic and proteolytic enzymes, and/or other enzymes which catalyse the myriad step-reaction activities of the present invention in the process of developing silver halides. Suitable enzymes of this type are made by Emkay Chemical Company of Elizabeth, N.J.

To obtain high emulsion speed in the present invention, dependence is made on the balancing of alkalies, on solvents, on surfactants, and on catalysts. This feature is achieved by the use of the combination of modified alkanolamides, diacetone alcohol, dimethyl formamide, potassium silicate, and enzymes with other chemicals. No other prior developers have used these chemicals in combination with each other, or proven a drastic exposure reduction (such as a decrease in X-ray radiation exposure to patients) because of such use.

TABLE 1

| | (to make 4 liters) |
|---|---|
| Solution I | |
| HOH | 2.9 liters |
| Potassium Silicate, 50% sol. (2.50:1 $SiO_2$:$K_2O$ mole ratio) | 50 ml |
| Sodium Sulfite (Anhydrous) | 395 gms |
| Ethylenediamine tetraacetic acid, tetrasodium salt (EDTA $Na_4$) 40% sol. | 25 ml |
| Potassium Hydroxide 50% sol. | 75 ml |
| Potassium Carbonate | 160 gms |
| Hydroquinone | 36 gms |
| Solution II | |
| HOH at 125° F.+ | 300 ml |
| Sodium Sulfite | 5 gms |
| p-Methylaminophenol sulfate (Elon) | 10 gms |
| (Add Sol. II to Sol. I; then add:) | |
| Methanol | 200 ml |
| Phenidone A | 10 gms |
| Isopropyl Alcohol (Anhydrous) | 10 ml |
| Benzotriazole 1% sol. | 50 ml |
| Sodium xylenesulfonate, 40% sol. | 100 ml |
| modified alkanolamide | 80 ml |
| Diacetone Alcohol | 10 ml |
| Dimethyl Ketone (Acetone) | 10 ml |
| Dimethylformamide | 5 ml |
| Enzymes (such as a standard mixture of amylolytic enzymes and catalysts, etc., used in the fabric cleaning industry; and/or proteolytic enzymes, etc.) | 2 ml |

What is claimed is:

1. A photographic chemistry comprising: a number of alkalies in a pH range from about 8 to 14; a developer in solution with said alkalies; a solvent mixed with the alkalies and the developer; a modified alkanolamide comprising cocamide and diethanolamine in solution with the alkalies, the developer and the solvent; and a hydrotrope mixed with the modified alkanolamide.

2. A photographic chemistry as set forth in claim 1, wherein the solvent is acetone.

3. A photographic chemistry as set forth in claim 1, wherein the developer is selected from the group consisting of hydroquinone, p-Methylaminophenol sulfate and phenidone.

4. A photographic chemistry as set forth in claim 1, wherein the alkalies are selected from the group including sodium sulfite, potassium carbonate, potassium silicate and potassium hydroxide.

5. A photographic chemistry as set forth in claim 1, wherein is included an emulsion penetrant in the solution.

6. A photographic chemistry as set forth in claim 5, wherein said emulsion penetrant is dimethyl formamide.

7. A photographic chemistry as set forth in claim 1, wherein is included a cleaner in the solution.

8. A photographic chemistry as set forth in claim 7, wherein the cleaner comprises diacetone alcohol.

9. A photographic chemistry as set forth in claim 1, wherein is included a lubricant in said solution, said lubricant being dimethylsulfoxide.

10. A photographic chemistry as set forth in claim 1, wherein said solution contains methanol to serve as a solvent, a cleaner, a buffering agent and an intermediate compatibility agent.

11. A photographic chemistry as set forth in claim 1, wherein is included a chelating agent in said solution.

12. A photographic chemistry as set forth in claim 11, wherein said chelating agent comprises ethylenediamine tetraacetic acid, tetrasodium salt (EDTA $Na_4$).

13. A photographic chemistry as set forth in claim 1, wherein is included an enzyme.

14. A photographic chemistry as set forth in claim 13, wherein the enzyme is selected from the group comprising amylolytic and proteolytic enzymes.

15. In a photographic chemistry: a modified alkanolamide comprising cocamide diethanolamine in solution; a developer and a hydrotrope in solution with the modified alkanolamide.

16. In a photographic chemistry as set forth in claim 15, wherein is included a solvent in solution with the modified alkanolamide.

17. In a photographic chemistry as set forth in claim 15, wherein is included a developer selected from the group consisting of hydroquinone, p-Methylaminophenol sulfate and phenidone, said developer being in solution with the modified alkanolamide.

18. In a photographic chemistry as set forth in claim 15, wherein is included a number of alkalies selected from the group including sodium silfite, potassium carbonate, potassium silicate and potassium hydroxide, the alkalies being in solution with said modified alkanolamide.

19. In a photographic chemistry as set forth in claim 18, wherein said alkalies are in a pH range of 8 to 14.

20. In a photographic chemistry as set forth in claim 15, wherein is included an emulsion penetrant in solution with said modified alkanolamide.

21. In a photographic chemistry as set forth in claim 20, wherein said emulsion penetrant is dimethyl formamide.

22. In a photographic chemistry as set forth in claim 15, wherein is included a cleaner in solution with said modified alkanolamide.

23. In a photographic chemistry as set forth in claim 22, wherein the cleaner comprises diacetone alcohol.

24. In a photographic chemistry as set forth in claim 15, wherein is included a lubricant in solution with said modified alkanolamide, said lubricant being dimethylsulfoxide.

25. In a photographic chemistry as set forth in claim 15, wherein said solution contains methanol to serve as a solvent, a cleaner, a buffering agent and an intermediate compatibility agent.

26. In a photographic chemistry as set forth in claim 15, wherein is included a chelating agent in said solution.

27. In a photographic chemistry as set forth in claim 26, wherein said chelating agent comprises ethylenediamine tetraacetic acid, tetrasodium salt (EDTA $Na_4$).

28. In a photographic chemistry as set forth in claim 15, wherein is included an enzyme.

29. In a photographic chemistry as set forth in claim 28, wherein the enzyme is selected from the group comprising amylolytic and proteolytic enzymes.

30. In a photographic chemistry as set forth in claim 15, wherein said hydrotrope is sodium xylenesulfonate.

31. In a photographic chemistry as set forth in claim 15, wherein the hydrotrope is in said solution in the range of 0.01% to 50% of the solution.

32. In a photographic chemistry as set forth in claim 15, wherein is included a quantity of dimethyl sulfoxide in solution with said modified alkanolamide.

33. In a photographic chemistry as set forth in claim 32, wherein said solution contains methanol to serve as a solvent, a cleaner, a buffering agent and an intermediate compatibility agent.

* * * * *